United States Patent [19]

King

[11] 4,255,006

[45] Mar. 10, 1981

[54] STRAIN-RELIEF MEMBER FOR REDUCING TORSIONAL STRAINS IN LINE CORD

[75] Inventor: Robert R. King, Maplewood, N.J.

[73] Assignee: Conair Corporation, Edison, N.J.

[21] Appl. No.: 46,999

[22] Filed: Jun. 11, 1979

[51] Int. Cl.[3] ..... H01R 13/56

[52] U.S. Cl. ..... 339/58; 339/101

[58] Field of Search ..... 339/101, 103 M, 106, 339/107, 108 R, 58

[56] References Cited

U.S. PATENT DOCUMENTS

| | | | |
|---|---|---|---|
| 2,171,331 | 8/1939 | Folsom, Jr. | 339/58 X |
| 3,497,608 | 2/1970 | Elliott et al. | 339/101 X |

*Primary Examiner*—John McQuade
*Assistant Examiner*—DeWalden W. Jones
*Attorney, Agent, or Firm*—Haynes N. Johnson; Joseph Levinson

[57] ABSTRACT

A strain-relief member is provided to relieve torsional strains from a two-conductor power supply cord attached to a personal care electrical appliance, such as a hand-held hair dryer, or curling iron. It is molded to the insulation of the two-conductor electrical power supply cord. Such torsional strains are primarily those resulting from twisting the wire about its longitudinal axis, as when using a curling iron, rather than from flexing.

The strain-relief member is an elongated body member of elastomeric material molded with the usual two-conductor line cord. It has a lateral projection or collar on one end thereof adapted to fit into the interior of the personal care electrical appliance to prevent rotation with respect to the appliance. The outer portion of the body member is uniformly tapered along its length on the sides adjacent to single conductors of said cord and has flattened, generally parallel sides extending along the opposite sides which are adjacent to both conductors of the power supply cord. The strain-relief member is made of elastomeric material of softness such that torsional stress is substantially uniformly distributed along the length of the member.

9 Claims, 6 Drawing Figures

STRAIN-RELIEF MEMBER FOR REDUCING TORSIONAL STRAINS IN LINE CORD

BACKGROUND OF THE INVENTION

This invention relates to a strain-relief member for a two-conductor power supply cord attached to a personal care electrical appliance, such as a curling iron or hand-held dryer, and more particularly to such a strain-relief member which spreads the stresses of twisting (torsional strains) flexing and bending in the electrical cord thereby reducing likelihood of fracturing of the line cord.

Personal care electrical appliances often require replacement of broken power supply cords. This is probably because such appliances are so moved and rotated in use as to bend, flex, twist and pull the cord, putting great torsional strain on the cord, particularly at the junction where it is coupled to the appliance.

The problem of open circuited power supply cords in personal care electrical appliances such as hair dryers, has resulted in the establishment, by Underwriters Laboratories, Inc., of proposed new requirements for testing resistance to torsion of line cords used in personal grooming appliances. Under the test procedures, the sample being tested is mounted in a test stand with a quarter pound weight attached to the cord at a minimum of eight inches from the point of entry of the cord into the appliance. The test stand is designed to be alternately and reversingly rotated 540 degrees about the axial center of the cord. The proposed standard is that the cord must withstand a minimum of 10 cycles of 540 degree rotations clockwise and counterclockwise per minute for a total number of 1,000 cycles. If the cord breaks during this test, it is deemed unsafe.

Among the approaches which have been taken to prevent fracture from torsional stress is to provide a swivelling electrical connector between the appliance and the line cord, for example, U.S. Pat. Nos. 1,090,238; 1,762,422; 3,427,976 and 3,950,052.

The present invention represents a different solution and can often go through 6,000 test cycles without fracture.

Other strain-relieving techniques have been suggested. See, for example, U.S. Pat. No. 3,093,432. These, however, are directed to relief from bending, not torsional, strains.

SUMMARY OF THE INVENTION

Accordingly, it is an object of the present invention to provide a new and improved strain-relieving member for a two-conductor electrical power supply cord used with personal care electrical appliances.

Another object of this invention is to provide a strain-relieving member for personal grooming electrical appliances which well exceeds the minimum requirements for line cords used in such appliances before breaking occurs.

In carrying out this invention, an elastomeric strain-relieving member is provided having an elongated body molded with the usual two-conductor power supply cord attached to the personal care appliance. The elongated body member has a collar with a lateral projection on one end thereof adapted to fit into the interior of the personal care electrical appliance to prevent rotation therein or removal therefrom when the line cord is placed under tension. A groove integral with the lateral projection on its body extends through the wall of the appliance. A slightly enlarged outer portion having a cylindrical cross-section is formed on the body immediately adjacent to and outside the wall of the appliance. In normal appliances this body is about 1½" to 4" long. The body is uniformly tapered along its length thereof and has flattened tapered sides. The taper is such that the cross-sectional area of the body is greatest adjacent the wall.

The strain-relieving member is comprised of a soft elastomer having a resiliency which distributes torsional and other forces substantially uniformly along the length of the body member. It is long and more flexible than strain-relief members commonly used and has a hardness durometer reading in the range of 40 to 70.

BRIEF DESCRIPTION OF THE DRAWINGS

The invention, together with further aspects, objects and advantages, thereof will be more clearly understood when considered in connection with the accompanying drawings.

DESCRIPTION OF THE PREFERRED EMBODIMENTS

Figure 1:
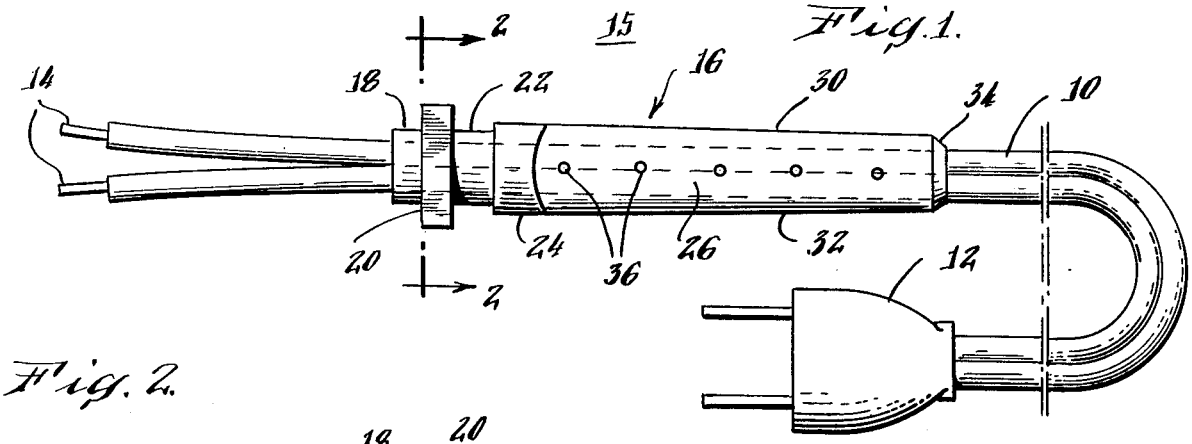
FIG. 1 is a top plan view of the strain-relieving member in accordance with the present invention shown integrally molded on a two-conductor power supply cord adapted to be attached to a personal care or grooming electrical appliance.

Referring now to FIG. 1, an insulated two-conductor power supply cord 10 of suitable length has a customary electrical plug 12 on one end. On the other end the insulation has been stripped at 14 so as to be connected internally to the personal care appliance 6 with which the line cord 10 is used.

A strain-relief member designated generally with the reference character 15 is integrally molded about the line cord 10 near the stripped insulated end 14 and serves to couple the line cord 10 with the housing 8 of the appliance 6. The function of the strain-relief member 15 is to absorb the torsional (rotary) forces applied to the line cord particularly near where the cord is attached to the appliance. This reduces the likelihood of fracturing of the electrical wires due to torsional stress, and so provides a line cord having a longer life.

Figure 2:
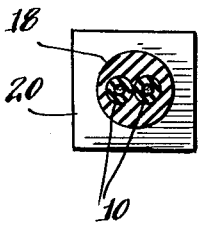
FIG. 2 is a left section on line 2—2 of FIG. 1.

The strain-relief member 15 has an elongated body member 16 with a collar 18 on one end thereof. Collar 18 includes an annular lateral flange or projection 20 thereon shaped for complementary fit within the housing of the appliance to prevent rotation therein. Often, as shown in FIG. 2, flange 20 is square in cross-section. An inner groove 22 is formed between the collar 18 and a slightly enlarged and cylindrical outer portion 24. Groove 22 is dimensioned to fit an opening in housing 8 in which the strain-relief member 15 is mounted.

Figure 5:
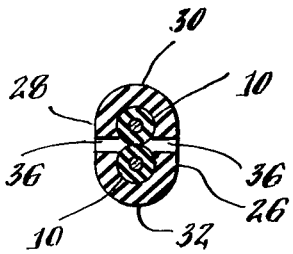
FIG. 5 is a cross-sectional view taken along line 5—5 of FIG. 4.
Figure 4:
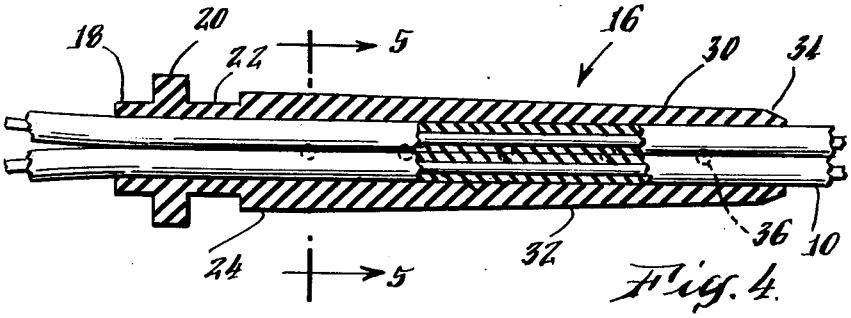
FIG. 4 is a cross-sectional view taken along line 4—4 of FIG. 3 (i.e., a section viewed from above) with part of the insulation on the two-conductor power supply cord broken away.

The sides 30 and 32 of outer portion 24 of the body member 16 are uniformly tapered along their length (see FIG. 4) and have their smallest cross-section farthest from the housing 8. These tapered sides 30 and 32 begin at the cylindrical end portion 24 and extend along opposite sides of the flat two-conductor power supply cord 10 for about 2½". Flat tapered sides 26 and 28 are joined at the top and bottom thereof by rounded surfaces 30 and 32 on opposite sides adjacent to the single conductors of power supply cord 10, giving the strain-relief member 15 what might be called a "generally elliptical cross-section" (see FIG. 5).

Figure 3:
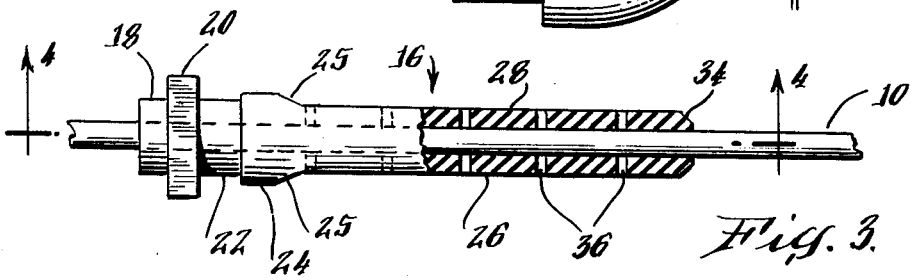
FIG. 3 is a side view (elevation), partly in section, showing the two-conductor power supply cord internally of the strain-relieving member.

As will be seen in FIG. 3, the tapered sides 26 and 28 are blended into the cylindrical portion 24 by a smooth inwardly extending slope 25. Outer, remote end 34 of the body member 16 is formed with an inward slope toward the power supply cord 10 to provide a smooth transition from the body member 16 to the cord 10. The cross-sectional area of member 15 adjacent remote end 34 should be sufficiently small as to permit rotation of the cord there; this prevents concentration of torsional stresses at that point.

Thus, as can be seen, the sides 26 and 28 of strain-relief member 15 in the plane of the two-power supply cord conductors are preferably substantially parallel (except at each end) though, if desired, they may have nominal taper. The sides 30 and 32, however, are tapered generally uniformly, giving the member 15 its greatest thickness adjacent housing 8 and its least thickness at its outer end. It is believed that this configuration, together with the particular elastomeric material used, serves to spread torsional stresses uniformly along the length of member 15 by causing the line cord 10 within member 15 to bend in a smooth, uniform arc when subjected to standard torsion stress tests. Similarly, the substantially parallel flat, tapered surfaces 26 and 28 have a tendency to resist the effects of rotational, torsional stress. Consequently, the effective torsional stress appears to be reduced by use of this tapered shape with generally elliptical cross-section, and the stress which remains is uniformly distributed along the length of the power supply cord 10, thus greatly reducing the fracturing component of stress at any given point on the power supply cord 10.

As indicated previously, the strain-relief member 15 is molded to the line cord 10. For that purpose a plurality of evenly spaced holes 36 are provided in surfaces 26 and 28 for centering the cord 10 in the mold. The insulated two-conductor power supply cord 10 is centered in the mold, and the strain-relief member 15 is integrally molded thereon. It should be appreciated that the strain-relief member 15 so formed is not necessarily bonded to the power supply cord 10 over its entire length particularly near the tapered end of the strain-relief member. Any separation in this area, however, is believed to enhance the ability of the cord 10 and its associated strain-relief member 15 to withstand torsional stresses. The degree and location of bonding between the insulation on the cord 10 and the elastomer used for the strain-relief member 15 will depend, for example, on the characteristics of the molded materials, size of the mold, where the elastomer is injected into the mold, etc. Preferably, sufficient bonding should be provided to enable the internal connections of the appliance to withstand an external pull of 35 pounds. The strain-relief member thus functions to relieve such stresses from the internal connections.

Figure 6:
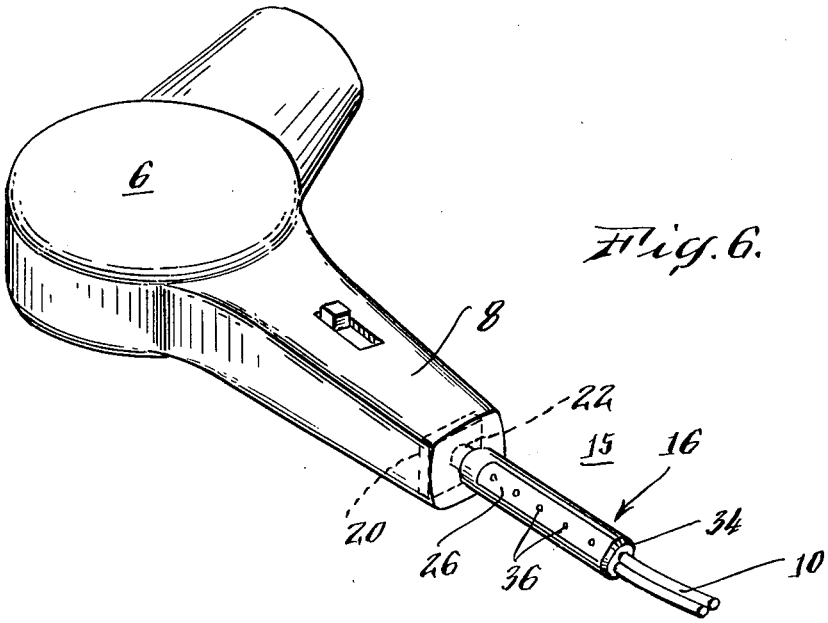
FIG. 6 illustrates the line cord having the stain-relieving member molded thereto attached to a hand-held hair dryer.

FIG. 6 illustrates the strain-relieving member 15, enclosing line cord 10 and mounted in the handle of the housing 8 of a hand-held hair dryer 6. As can be seen, square-shaped collar 20 fits the inside of the housing 8 in such manner as to prevent rotation of member 15; and the opening in housing 8 fits into inner groove 22.

As indicated, the strain-relieving member 15 should distribute torsional stresses substantially uniformly along its length (to best reduce the stress at any particular point). This will not occur under the accepted test conditions if the elastomer of member 15 is too rigid. Similarly, it will not occur if the elastomer is so flexible as to provide but nominal resistance. Consequently, an elastomer of soft material of lower than usual durometer rating is required; but, if too low, it is ineffective. One such material which has been found suitable for the present application is polyvinyl chloride having a hardness durometer reading in the range of from 40 to 70 measured on a standard Type A durometer instrument, e.g. Model 306 made by Pacific Transducer Corp., Los Angeles, California in accordance with ASTM D2240. The elastomer must also possess long life without deterioration, must be inherently moisture and flame resistant, must have a smooth appealing appearance, and should be suitable for integral molding to the line cord 10.

The longer length of the strain-relief member 15, made of a soft elastomer, together with the specified flat and rounded sides, provide a strain-relief member serving to spread the torsional stresses over its entire length. The configuration described tends to provide a uniform bend or flexing which is also distributed uniformly over the length of the outer portion 24. The flattened tapered configuration of the sides 26 and 28 are particularly useful in absorbing and uniformly distributing torsional forces as well as being flexible for bending and flexing.

With respect to the power supply cord 10, the maximum number of individual strands in each conductor in cord 10 provides for most flexibility. Tests, using prescribed Underwriters Laboratories, Inc. proposed standards of subjecting the line cord of hair dryers to 540 degrees reverse twist cycles at a minimum of 10 cycles per minute for 18AWG conductors with 65 strands of No. 36AWG wire, provided an average of above 13,000 flex cycles before failure of the line cord. This considerably exceeds the 1,000 minimum cycle proposed requirement set by UL standards. In view of these results, the strand size of the wire may be the standard 41 strands of No. 34AWG wire for a No. 18AWG conductor size and the advantages of the invention are still achieved.

From the above description it can be seen that an improved strain-relief member has been provided for personal care appliances in which a unique elongated tapered strain-relieving member provides optimum strain-relief in all directions from the torsional and other stresses to which these appliances are subjected in normal usage.

What is claimed is:

1. A strain-relief member for use with an electrical two-conductor power supply cord at the point said cord enters the cord opening in the housing of a hand-held personal care electrical appliance to reduce torsional stresses, said strain-relief member including:

a body surrounding said cord and having an inner annular flange and an outer portion, said flange surrounding said power supply cord internally of said housing and being shaped to complementarily fit within said housing to prevent rotation therein, said outer portion integral with said flange and extending outwardly from said housing and around said cord, said outer portion having a cylindrical cross-section adjacent said housing, and having rounded and flattened portions removed from said housing giving said body a generally elliptical cross-section, said flattened portions being on opposite sides and proximate to the flat, two-conductor power supply cord and said rounded sections being on opposite sides and each being proximate to a single conductor of the power supply cord, said flattened portions being uniformly tapered inwardly from said adjacent cylindrical cross-section outer portion to the end remote from said housing, said body being molded about said cord and being made of elastomeric material of such softness that torsional stresses are substantially uniformly distributed throughout the tapered length of said body, whereby likelihood of fracture of said power supply cord due to torsional and other stresses is reduced by distributing said forces substantially uniformly along said strain-relief member.

2. The strain-relief member set forth in claim 1 wherein said strain-relief member is integrally molded to said cord.

3. The strain-relief member set forth in claims 1 or 2 in which said elastomeric material is a plastic having hardness durometer readings in the range of from 40 to 70.

4. The strain-relief member set forth in claim 1 in which said elastomeric material is polyvinyl chloride.

5. The strain-relief member set forth in claim 1 in which said body has an annular groove between said annular flange and said outer portion dimensioned to fit within an opening in said housing.

6. A strain-relief member to reduce torsional stress on a two-conductor power supply cord attached to the housing of a personal care electrical appliance, said strain-relief member including:

an elongated body member integrally molded to said two-conductor power supply cord and having an annular flange on one end thereon shaped and dimensioned to fit inside the housing of said personal care electrical appliance to prevent rotation therein or removal therefrom when the line cord is placed under tension, an annular groove on said body member proximate to said annular flange adapted to fit within an opening in said housing, said body member having an enlarged outer portion adjacent said groove and having a generally cylindrical cross-section adjacent said electrical appliance, to be positioned outside said housing, said outer portion being uniformly tapered along the length thereof and having flattened tapered sides thereon spaced from the cylindrical end thereof extending along opposite sides of the flat, two-conductor power supply cord and joined by rounded sections on opposite sides adjacent to the single conductors of the power supply cord, and said strain-relief member being comprised of a soft, elastomeric material having a softness that will substantially uniformly distribute torsional stress along the length of said member, whereby said power supply cord is provided with increased support and flexibility over the length of said strain-relief member.

7. The strain-relief member set forth in claim 6 in which said soft elastomeric material is comprised of polyvinyl chloride.

8. The strain-relief member set forth in claims 6 or 7 in which the hardness of said elastomeric material has a durometer reading in the range of 40 to 70.

9. In a hand-held personal care electrical appliance of the type having a handle to which electrical connections are internally made from a two-conductor power supply cord through a strain-relief member passing through the housing of said appliance, said strain-relief member comprising:

an elongated body member integrally molded to said two-conductor power supply cord and having an annular flange on one end thereon shaped and dimensioned to fit inside the handle of said personal care electrical appliance to prevent rotation therein or removal therefrom when the line cord is placed under tension, an annular groove on said body member proximate to said annular flange, said groove being adapted to fit within an opening in said housing, said body member having an enlarged outer portion adjacent said groove and having a generally cylindrical cross-section adjacent said electrical appliance, positioned outside said housing, said outer portion being uniformly tapered along the length thereof and having flattened tapered sides thereon spaced from the cylindrical end thereof, extending along opposite sides of the flat, two-conductor power supply cord, and joined by rounded sections on opposite sides adjacent to the single conductors of the power supply cord, and said strain-relief member being comprised of a soft, elastomeric material having a softness that will substantially uniformly distribute torsional stress along the length of said member, whereby said power supply cord is provided with increased support and flexibility over the length of said strain-relief member.

* * * * *